US010960367B1

(12) United States Patent
LoPresti

(10) Patent No.: US 10,960,367 B1
(45) Date of Patent: Mar. 30, 2021

(54) POWDER INDUCTIONS UTILIZING POSITIVE DISPLACEMENT TWIN SCREW PUMP TECHNOLOGY

(71) Applicant: William J. LoPresti, Marietta, GA (US)

(72) Inventor: William J. LoPresti, Marietta, GA (US)

( * ) Notice: Subject to any disclaimer, the term of this patent is extended or adjusted under 35 U.S.C. 154(b) by 251 days.

(21) Appl. No.: 15/371,264

(22) Filed: Dec. 7, 2016

Related U.S. Application Data

(60) Provisional application No. 62/268,076, filed on Dec. 16, 2015.

(51) Int. Cl.

| | |
|---|---|
| ***B01F 5/04*** | (2006.01) |
| ***B01F 5/10*** | (2006.01) |
| ***B01F 3/12*** | (2006.01) |
| ***B01F 15/00*** | (2006.01) |
| ***B01F 15/02*** | (2006.01) |

(52) U.S. Cl.
CPC ..... *B01F 5/043* (2013.01); *B01F 3/1271* (2013.01); *B01F 5/106* (2013.01); *B01F 15/00136* (2013.01); *B01F 15/00162* (2013.01); *B01F 15/00253* (2013.01); *B01F 15/0283* (2013.01); *B01F 2003/125* (2013.01)

(58) Field of Classification Search
CPC ..... B01F 5/0413
USPC ..... 366/163.2, 136, 137
See application file for complete search history.

(56) References Cited

U.S. PATENT DOCUMENTS

| | | | | | |
|---|---|---|---|---|---|
| 4,738,540 | A * | 4/1988 | Banks | B01F 3/0865 | 366/137 |
| 4,863,277 | A * | 9/1989 | Neal | B01F 3/1271 | 366/137 |
| 5,344,619 | A * | 9/1994 | Larwick | B01F 1/00 | 366/163.2 |
| 5,634,715 | A * | 6/1997 | Stehr | B01F 3/1271 | 366/137 |
| 6,361,201 | B1 * | 3/2002 | Russell | A61M 1/1656 | 366/136 |
| 7,901,571 | B2 * | 3/2011 | Woods | B01F 3/1228 | 210/96.1 |
| 2014/0318772 | A1 * | 10/2014 | Boyd | E21B 21/106 | 166/267 |

* cited by examiner

*Primary Examiner* — David L Sorkin
(74) *Attorney, Agent, or Firm* — James Creighton Wray

(57) ABSTRACT

One or more twin screw pumps prevent backflow of wetted powder and jamming of powder eductors. A twin screw pump at an exit of a powder eductor produces a vacuum in the eductor to prevent backflow. A twin screw pump in a liquid input line produces a strong liquid stream through the eductor. A viscous or recycled fluid bypasses the eductor or is pumped through the eductor using the twin screw pump in the eductor liquid input line. The twin screw pump at the eductor output reduces the eductor exit pressure and draws a viscous liquid stream from the eductor. The powder-laden stream is directed for processing or recycling.

15 Claims, 2 Drawing Sheets

POWDER INDUCTIONS UTILIZING POSITIVE DISPLACEMENT TWIN SCREW PUMP TECHNOLOGY

This application claims the benefit of U.S. Provisional Application No. 62/268,076 filed Dec. 16, 2015, which is hereby incorporated by reference in its entirety as if fully set forth herein.

BACKGROUND OF THE INVENTION

There are many methods of incorporating powders into liquids on a continuous basis, but there are several challenges with the current methodologies. When powder is held in a hopper prior to being introduced into the liquid stream, there are often times when this hopper holding the powder sees contact with the liquid and results in the wetting of powder in the hopper. This wetting of the powder can cause a variety of problems which prevent the free flow of solids into the liquid stream into which the solids are to be incorporated. Backflow of liquid into the hopper usually occurs when downstream pressures increase as a result of increasing viscosity of the liquid stream or with when changes in downstream restrictions cause high downstream pressures. Incorporating powders into a high pressure line can also be a challenge.

These problems are common with eductor use and in systems that utilize liquid ring pumps to produce vacuum

SUMMARY OF THE INVENTION

Use of a twin screw pump in the powder induction system can eliminate problems of backflow while handling a significantly wide range of viscosity, and developing considerably higher discharge pressures.

The following summarizes two types of powder incorporation systems utilizing twin screw pumps.

The first is a system, designated SYSTEM A, which utilizes one or two twin screw pumps and locates one twin screw positive displacement pump downstream of the eductor. The eductor can be any type of suction tee arrangement that creates a negative pressure on the powder inlet side. This system eliminates backflow in the powder eductor by driving the downstream pump so that its capacity is capable of removing the volume delivered to its suction side from the eductor discharge, resulting in a slight vacuum condition at the pump suction. It can also provide high discharge pressures without interfering with the eductor's powder incorporation capability.

The second, SYSTEM B, utilizes a single twin screw pump upstream of the eductor. This pump allows recirculation of liquid and will continue to function even as the viscosity increases as a result of the increase in the percentage of solids in the recycle stream.

The new power induction system uses one or two twin screw pumps to incorporate powder into a liquid stream. A powder eductor has a liquid input, a powder input and a liquid-powder output. A powder hopper contains powder to be inducted into the liquid stream. A powder discharge is connected to the powder hopper. A powder valve is connected to the powder discharge and to the powder input of the powder eductor. The powder valve opens, flowing powder from the powder hopper through the powder discharge and the powder input of the eductor and into the liquid stream. A liquid input line is connected to the liquid input of the powder eductor. A flow meter is mounted in the liquid input line, and a modulating or shutoff valve is connected to the liquid input line. A first pressure sensor is connected to the liquid input line. An output line is connected to the liquid-powder output of the powder eductor, and a second pressure sensor is connected to the output line.

A main twin screw pump is connected either to the liquid-powder output line or to the liquid input line. The main twin screw pump moves the liquid stream and the liquid-powder combination through the in-line powder eductor. In one embodiment, the main twin screw pump is connected to the liquid input line. In another embodiment, the main twin screw pump has an intake connected to the eductor liquid-powder output line. A third pressure sensor is connected to the output of the twin screw pump.

A three-way valve is connected to direct the liquid-powder output to a processing input line for use of the liquid-powder blend or to a batch tank for recycling the mixture.

A batch tank pump is connected to the batch tank, and a valve is connected between the batch tank pump and the powder eductor liquid input line for flowing liquid pumped from the batch tank into the liquid input line.

In one form, the batch tank pump is a centrifugal pump for pumping a single pass liquid from the batch tank into the eductor liquid input line. In another form, the batch tank pump is a twin screw pump for pumping a recycled liquid-powder mixture or a viscous liquid from the batch tank through a valve to the eductor liquid input line. Another valve is connected between an external water or liquid source and the eductor liquid input line. In that embodiment, the main twin screw pump is connected between the batch tank and the liquid input line to positively force a strong liquid stream through the powder eductor.

The new main twin screw pump powder-into-liquid induction system has an in-line powder eductor having a liquid inlet, a powder inlet and a liquid-powder outlet. A powder valve is connected to the powder inlet of the powder eductor, and a powder hopper is connected to the powder valve. A liquid input line is connected to the liquid inlet of the powder eductor. A liquid and powder output line is connected to the liquid-powder outlet of the powder eductor. A first pressure indicator is connected to the liquid input line. A second pressure indicator is connected to the liquid and powder output line. A twin screw pump is connected to at least one or both of the liquid input line and the liquid and powder output line. A processing line is selectively connectable to the liquid and powder output line.

These and further and other objects and features of the invention are apparent in the disclosure, which includes the above and ongoing written specification, with the claims and the drawings.

DETAILED DESCRIPTION

Figure 1:
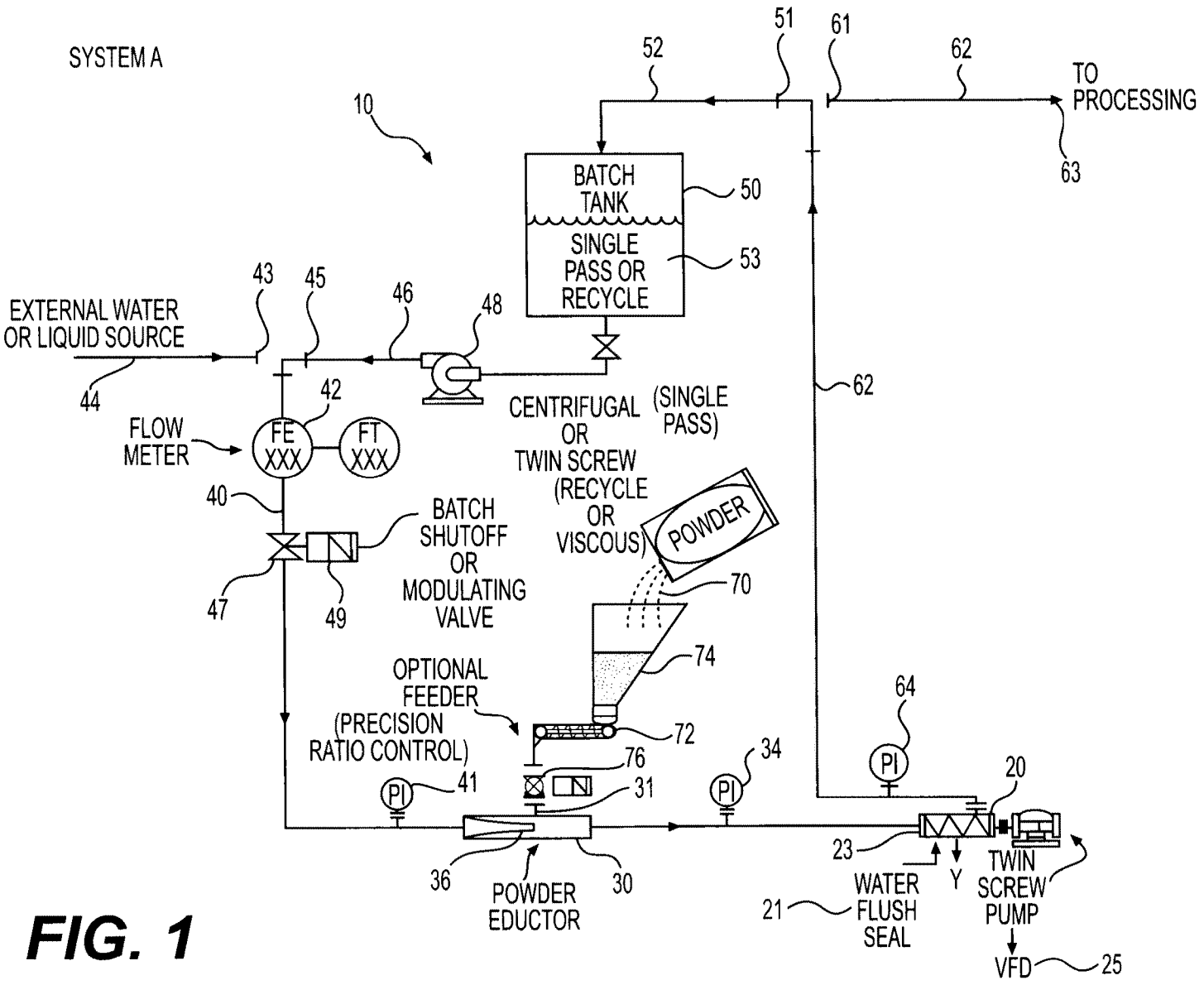
FIG. 1 is a System A overview in a schematic representation showing a twin screw pump at the output of the eductor to draw the powder-enriched liquid stream through the eductor.

FIG. 1 is a system A overview in a schematic representation. A virtually pulse-free twin screw positive displacement pump 20 is integrated into a dry solids incorporation system 10, which prevents backflow of liquid and develops high enough discharge pressures to satisfy the downstream pressure requirements. The following presents the details of such a system, which can have the added benefit of metering a specific flow rate of powder into a given preset flow rate of liquid in order to achieve accurate continuous blending proportions.

The system 10 that is presented uses an eductor 30. The motive force for the operation of the eductor is a flowing liquid 40 under pressure 41. This liquid stream 40 can be water from a municipal water line 44 or similar source (Option A1), or can be a liquid 46 that is pumped 48 from a tank 50 to the eductor (Option A2). Both of these options will contain one twin screw pump 20 located downstream of the eductor 30. Using a twin screw positive displacement pump as a liquid source pump, which is the two pump option (Option A2), has the advantage of being able to handle low and high viscosity liquids, either in a single pass 62 or in a recycle loop 52 back to the source tank 50 and is able to consistently maintain required differential pressure across the eductor nozzle as the viscosity of the liquid increases.

The following will present the three different options using the "downstream" twin screw pump 20, which is being generally referred to as SYSTEM A.

System A Options Include:

Option A1) Continuous incorporation of dry powder 70 into a metered 42 liquid stream 40 using a metered 44 water source under pressure which is indicated by pressure indicator gauge 41.

Option A2) Continuous incorporation of dry powder 70 into a metered 42 liquid stream 40 using a supply pump 48, preferably a twin screw, in order to handle high or low viscosity.

Option A3) Continuous blending and metering 72 of dry powder 70 into a metered 42 liquid stream 40 with precise metering of powder using a volumetric or loss in weight feeder 72 for the powder to maintain an accurate blend ratio.

All three options will use the twin screw pump 20 downstream of the powder incorporation to prevent backflow and to deliver the needed pressure.

In all three above mentioned options, the package includes the following main process components:

1) A hopper 74 holds the dry powder 70 (solids to be incorporated).

2) An eductor 30 utilizes a flowing liquid stream 40 as the motive force for the eductor. The downstream twin screw pump 20 produces the vacuum in the eductor 30 that enables incorporation of the solids 70 into the liquid stream. The nozzle 36 size is selected based on the required flow rates.

For powder and liquid flow rate control, a specific nozzle 36 is selected that will incorporate the approximate desired powder flow based on the liquid flow rate setpoint.

3) A liquid flow metering device 42 provides a continuous flow rate output signal to a flow controller or, when a batch recirculation method is used, to build concentration. This flow meter 42 may be needed only when precise flow control is required for a once through operation, or may be needed to be used as a means of batch control to dispense a known quantity of liquid into a supply tank 50 or downstream to a surge or blend tank.

4) A supply and shutoff valve 47 and valve 49 with required signal conditioning can be used to modulate the flow of liquid to the eductor 30 and, as part of a flow control loop. An automatic valve and batch control device can be used to deliver a pre-set flow rate of liquid to the eductor 30. If the process is one of batch recirculation or batch delivery of liquid, the valves 47, 47A can be used to shut off the flow to the eductor and bypass the eductor as dictated by the predetermined set point.

5) One twin screw positive displacement metering pump package 20 is located downstream of the eductor 30. A double mechanical pump seal 23 with a water flush 21 keeps the seal faces clean and allows the pump to run dry. This seal arrangement is a requirement.

6) The system includes miscellaneous gauges, valves, fittings, and interconnecting piping.

Option A1

The liquid stream 40 into which the dry powder 70 will be incorporated is water coming from an existing plant or municipal water system 44 with sufficient pressure to drive the eductor 30. The flow rate can be set by a flow metering loop if required.

A twin screw positive displacement pump package 20 located downstream of the eductor 30 will run at a speed set by a variable frequency drive (VFD) 25 that insures a low or slightly negative suction side pressure 34.

The operation is as follows:

1) A hopper located 74 on top of the eductor 30 dry side inlet 31 is filled with dry powder 70, isolated by a closed valve 76.

2) Valves 51, 61 are arranged to send the downstream liquid/slurry stream to the appropriate location.

3) Liquid flow 40 is introduced as the motive force for the eductor 30 by slowly opening the supply valve 47. This flow rate can be preset by a flow loop if required or can be inferred by use of specific nozzle 36 geometry. The twin screw pump 20 with an open path downstream will flood and spin slowly.

4) The variable frequency drive 25 will be then used to increase the speed of the pump 20 while observing a gauge 34 at the pump suction. When the pressure indicator gauge 34 shows a negative pressure, the speed is set. Adjustments will be made so that an acceptable steady state flow is achieved.

5) The valve 76 at the hopper discharge is opened, allowing the powder to enter the eductor 30 stream and combine with the liquid.

6) The downstream twin screw pump 20 will deliver the blended liquid and powder at a pressure indicated by pressure indicator gauge 64 to the appropriate location for further processing 63 until the powder requirement for the batch is satisfied.

Option A2

The liquid stream 40 into which the dry powder 70 will be incorporated is water coming from local liquid supply centrifugal pump 48, or a twin screw positive displacement pump (for high viscosity liquids).

The additional main equipment required will be a tank 50 and pump 48 to provide the liquid to the eductor 30. Pump 48 can be either a twin screw positive displacement pump for high viscosity liquids, or a centrifugal pump for low viscosity liquids. The flow rate can be set by a flow metering loop if required. The tank 50 will be used to provide surge for the pump 48 and can also be used as a recycle tank to build concentration if required.

The second pump is the required twin screw positive displacement pump package 20 located downstream of the eductor 30, which will run at a speed set by a VFD 25 that insures a low or slightly negative suction side pressure 34.

Operation is as follows:

1) A hopper 74 located on top of the eductor 30 dry side inlet 31 is filled with dry powder 70, isolated by a closed valve 76.

2) The surge tank 50 that feeds the upstream pump 48 is filled with liquid 53 to be used as the solvent or carrier liquid for the slurry. If the tank 50 is local and used for recycle, a pre-set quantity is usually batched into the tank 50. If the flow is to be continuous to another destination, the tank 50 will feed the upstream pump 48 that will then feed the eductor 30.

3) Valves 51, 61 are arranged to send the downstream liquid/slurry stream 62 to the appropriate location. If recycle is desired, then once the supply tank 50 has sufficient volume, the valves 43, 45 are rearranged, and the recycle path is set so that the tank 50 feeds the pump 48 suction.

4) Flow is introduced as the motive force for the eductor 30 by starting the upstream pump 48 and either slowly opening the supply valve 45 to allow flow or slowly increasing the pump 48 speed. This flow rate can be preset by a flow loop if required or can be inferred by use of specific nozzle geometry. The twin screw pump 20 with an open path downstream will flood and spin slowly.

5) The variable frequency drive 25 will be then used to increase the speed of the pump 20 while observing a gauge 34 at the pump suction. When the gauge 34 shows a negative pressure, the speed is set. Adjustments will me made so that an acceptable steady state flow is achieved.

6) The valve 76 at the hopper 74 discharge is opened, allowing the powder 70 to enter the eductor stream and combine with the liquid.

7) The downstream twin screw pump 20 will deliver the blended liquid and powder back to the recycle tank 50 in a recirculation process until proportional requirements are satisfied or to the appropriate location 63 for further processing if a once through process.

A liquid supply under pressure can come from a municipal water supply 44 pump. As noted, the use of a twin screw positive displacement (PD) pump 48 to supply the flow and pressure needed upstream of the eductor 30 has the advantage of providing a consistent, virtually pulse free liquid stream of low or high viscosity to the eductor nozzle 36. If a recycle loop 52 is used to concentrate the solids 70 in the liquid and a high viscosity in the source tank 50 is the result, the twin screw pump 48 can handle the process and maintain the required differential pressure.

In its simple form where high precision ratio control is not required, the powder feed hopper 74 can be filled, and the nozzle 36 size can be selected to incorporate the dry solids 70 into the liquid with predictable results.

When precise ratio control is needed, flow control instrumentation and a dry powder feeder 72 can be incorporated into the system, which will allow that flows of liquid and powder can each be maintained at specific settings.

With use of a municipal water supply source 44 or other liquid stream 40 supplied to the eductor nozzle 36, the only requirement is for the twin screw pump 20 downstream of the eductor 30.

In cases where precise proportioning of powder in weight per unit time (pounds per minute) into a controlled liquid flow rate (gallons per minute), a system package is employed with flow control instrumentation.

System B

Figure 2:
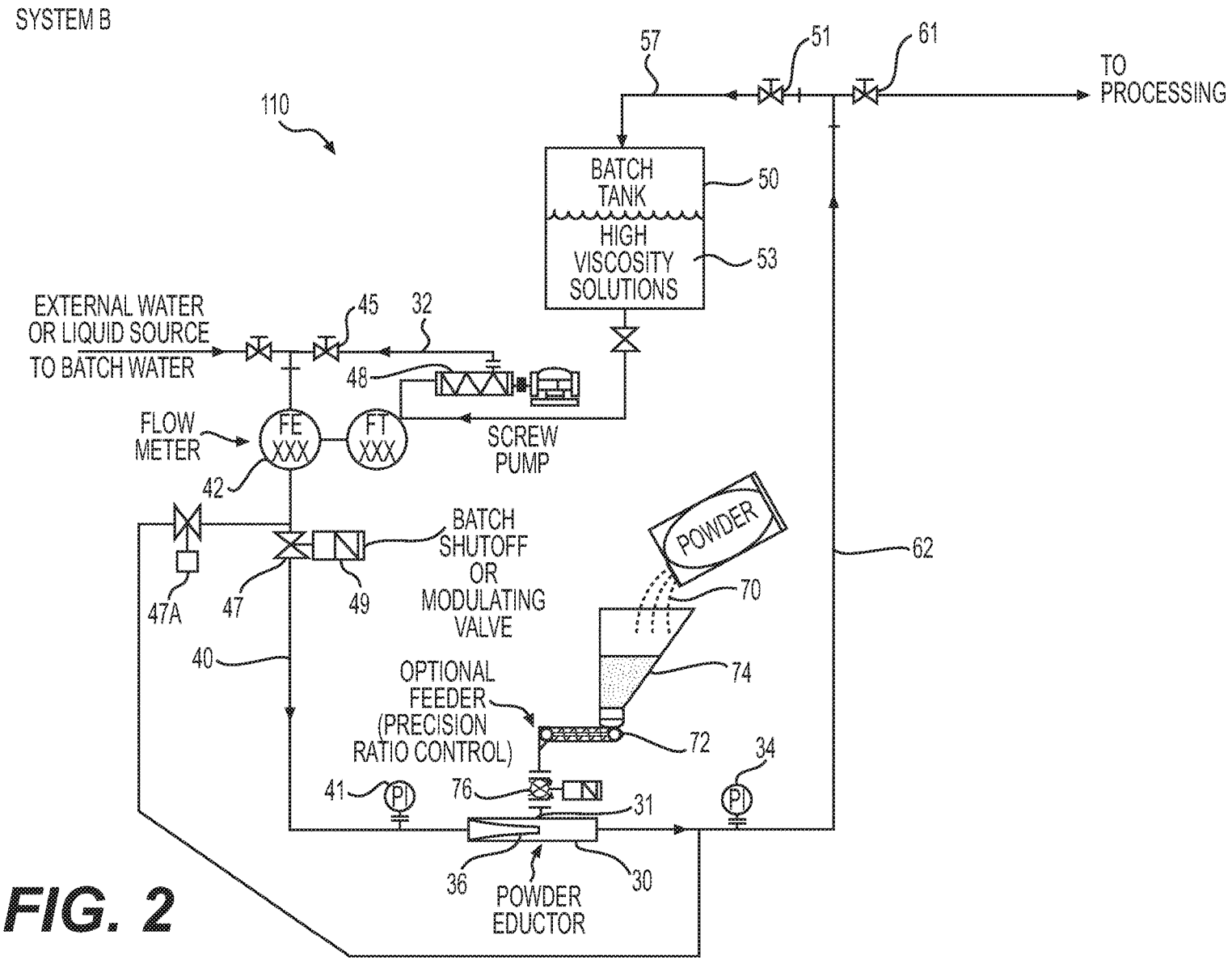
FIG. 2 is a System B overview in a schematic representation showing a twin screw pump providing an input liquid stream to induce a flow through the eductor.

FIG. 2 is a System B overview in a schematic representation. System B utilizes a single twin screw pump 48 upstream of an eductor 30 which pulls powder 70 into the eductor by creating the required differential pressure. The discharge 62 will re-circulate back to the source tank 50 from which the liquid was initially drawn to supply the pump 48. What makes the twin screw unique in this system is that the twin screw, although a positive displacement pump, is virtually pulse free, and the smooth flow works well in conjunction with the eductor 30. The twin screw pump 48 can also handle significantly higher viscosity liquids than other pumps, thus allowing the recycled liquid to increase in viscosity as the solids concentration increases as a result of incorporating the powder.

The System B package 110 includes the following main process components:

1) A hopper 74 holds the dry powder 70 (solids to be incorporated).

2) A batch tank 50, into which the initial volume of liquid is to be metered, is subsequently used for recirculation to pick up and concentrate the solids 70 into a slurry or solution.

3) An eductor 30 utilizes a flowing liquid stream 40 as the motive force for the eductor. The eductor 30 produces the vacuum that enables incorporation of the solids into the liquid stream. The nozzle 36 size will be selected based on the required flow rates.

For powder and liquid flow rate control, a specific nozzle 36 is selected that will incorporate the approximate desired powder flow based on the liquid flow rate setpoint. A metering device 72 for powder can be used for this purpose as well, if required.

4) An optional liquid flow metering device 42 provides a continuous flow rate output signal to a flow controller or when a batch recirculation method is used to build concentration. This optional flow meter may be needed only when precise flow control is required for a once through operation, or may be needed to be used as a means of batch control to dispense a known quantity of liquid into a supply tank 50 or downstream to a surge or blend tank.

5) Valve 47 is a shutoff valve 47. An automatic valve and batch control device can be used to deliver a pre-set flow rate of liquid to the eductor. In batch recirculation, the valves 45, 47, 51, 61 can be used to shut off the flow as dictated by the predetermined set point.

A variable frequency drive (VFD) controls the speed of the twin screw pump 48. This allows modulating the flow as indicated by the flowmeter 42.

Flow control if needed can be done with the VFD. Valve 47 can be a three-way valve or can be used in conjunction with valve 47A which will serve as bypass valve. The combination will serve as a three-way with positive shutoff. This arrangement allows for either feeding the eductor directly or bypassing it completely. Bypass should occur only when one wants to send the completed batch to processing without the added pressure drop of the eductor after all the powder is incorporated to the batch. Valve 47 in FIG. 2 is a batch shutoff and 47A is the eductor bypass valve.

The optional feeders in the drawings are depicted as screw feeders. They can be screw or rotary airlock feeders, weigh belt feeders, or volumetric or loss in weight feeders.

6) One twin screw positive displacement pump package 48 located upstream of the eductor 30 will provide the motive force for the operation of the eductors.

7) Miscellaneous gauges, valves, fittings, and interconnecting piping are provided.

Operation would be as follows:

1) A hopper 74 located on top of the eductor 30 dry side inlet 31 is filled with dry powder 70, isolated by a closed valve 76.

2) The surge tank 50 that feeds the upstream pump 48 is filled with liquid 53 to be used as the solvent or carrier liquid for the slurry. This tank 50 is used for recycle; a pre-set quantity is usually batched into the tank. Valves 45, 47, 51, 61 will be arranged. The tank 50 will feed the upstream pump 48 that will then feed the eductor 30 and re-circulate the slurry back to the tank.

3) Flow is introduced as the motive force for the eductor 30 by arranging the valves 45, 47, 51, 61 appropriately, starting the pump 48, and then slowly increasing the pump speed. This flow rate can be preset by a flow loop if required (usually not necessary) or can be inferred by use of a specific nozzle 36 geometry and variable frequency drive (VFD) setting for pump 48.

4) The valve 76 at the hopper discharge 31 is opened, allowing the powder 70 to enter the eductor 30 stream and combine with the liquid.

5) Recycling 52 of the liquid takes place until the predetermined amount of powder 70 is introduced and the target concentration of powder into liquid is achieved.

While the invention has been described with reference to specific embodiments, modifications and variations of the invention may be constructed without departing from the scope of the invention, which is defined in the following claims.

I claim:

1. Apparatus comprising:

a powder induction system incorporating powder into a liquid stream, including a powder eductor comprising a suction tee arrangement having a liquid input, a powder input and a liquid-powder output, a powder hopper containing powder to be inducted into the liquid stream, a powder discharge connected to the powder hopper, a powder valve connected to the powder discharge and to the powder input of the powder eductor, the powder valve opening and flowing powder from the powder hopper through the powder discharge into the powder input of the eductor and into the liquid stream, an eductor input line connected to the liquid input of the powder eductor, a flow meter mounted in the liquid input line, a modulating or shutoff valve connected to the liquid input line, a first pressure sensor connected to the liquid input line, an eductor liquid-powder output line connected to the liquid-powder output of the powder eductor, a second pressure sensor connected to the eductor output line, and a positive displacement twin screw pump having a suction side connected to the eductor liquid-powder output line and the positive displacement twin screw pump adapted for removing a volume delivered to its suction side, resulting in a slight negative pressure at its suction side.

2. The apparatus of claim 1, further comprising a fluid delivery line, and wherein the positive displacement twin screw pump further comprises a a twin screw pump output, the twin screw pump suction-side being connected to the liquid-powder output line and the positive displacement twin screw pump output being connected to the fluid delivery line.

3. The apparatus of claim 2, further comprising a third pressure sensor connected to the delivery line.

4. The apparatus of claim 3, further comprising a first valve connected to the delivery line, and a processing input line connectable to the first valve.

5. The apparatus of claim 4, further comprising a second valve connected to the delivery line, a batch tank connected to the second valve, a batch tank pump connected to the batch tank, and a third valve connected between the batch tank pump and the liquid input line for flowing liquid pumped from the batch tank into the eductor input line.

6. The apparatus of claim 5, wherein the batch tank pump is a centrifugal pump for pumping a single pass liquid from the batch tank into the eductor input line.

7. The apparatus of claim 5, wherein the batch tank pump is a twin screw pump having an intake connected to the batch tank for pumping a single pass liquid, a recycling liquid-powder blend or a viscous liquid from the batch tank through the third valve to the eductor input line.

8. The apparatus of claim 5, further comprising an external water or liquid source and a fourth valve connected between the external water or liquid source and the eductor input line.

9. The apparatus of claim 1, further comprising a batch tank, and wherein another twin screw pump is connected between the batch tank and to the eductor input line to positively force a liquid flow stream through the powder eductor.

10. Apparatus comprising:

a powder-into-liquid induction system, further comprising an in-line powder eductor comprising a suction tee having a liquid inlet, a powder inlet and a liquid-powder outlet, a powder valve connected to the powder inlet, a powder hopper connected to the powder valve, a liquid input line connected to the liquid inlet, a liquid-powder output line connected to the liquid-powder outlet, a first pressure indicator connected to the liquid input line, a second pressure indicator connected to the liquid-powder output line, and a positive displacement twin screw pump having a suction side connected to the liquid-powder output line the positive displacement twin screw pump adapted for pumping liquid and powder from the liquid-powder output line, and creating a negative pressure at the suction side of the positive displacement twin screw pump.

11. The apparatus of claim 10, further comprising a processing line selectively connectable to a pump output line connected to an output side of the positive displacement twin screw pump.

12. The apparatus of claim 10, further comprising a flow meter and a batch shutoff or modulating valve connected to the liquid input line.

13. The apparatus of claim 11, further comprising a liquid source line and a batch tank line selectively connectable to the liquid input line, a batch tank pump and a batch tank sequentially connected to the batch tank line, and a batch tank inlet line selectively connectable to the pump output line.

14. The apparatus of claim 13, wherein the batch tank pump is a second twin screw pump.

15. A process comprising:

inducting powder in a flowing stream of liquid, providing an in-line powder eductor comprising a suction tee having a liquid input, a powder input and a liquid-powder output, providing a powder hopper, a powder metering feeder and a powder valve between the hopper and the powder input of the powder eductor, providing an input stream line connected to the liquid input of the suction tee arrangement, providing a first pressure indicator, a flow meter and a valve connected to the inlet stream line, providing a liquid-powder line connected to the liquid-powder output of the suction tee arrangement, providing a second pressure indicator in the liquid-powder line, providing a twin screw pump having a suction side connected to the liquid powder output line, and the twin screw pump providing a negative pressure in the liquid-powder line providing a process stream line connectable to an output side of the twin screw pump.

* * * * *